US005398815A

United States Patent [19]

Hadden

[11] Patent Number: 5,398,815

[45] **Date of Patent: * Mar. 21, 1995**

[54] LANDFILL WASTE MATERIAL SEPARATING METHOD

[75] Inventor: Robert J. Hadden, Middleborough, Mass.

[73] Assignee: The Read Corporation, Middleboro, Mass.

[ * ] Notice: The portion of the term of this patent subsequent to Jun. 21, 2011 has been disclaimed.

[21] Appl. No.: 221,471

[22] Filed: Mar. 31, 1994

Related U.S. Application Data

[63] Continuation of Ser. No. 958,274, Oct. 8, 1992, Pat. No. 5,322,170, which is a continuation-in-part of Ser. No. 834,641, Feb. 12, 1992, Pat. No. 5,219,078, which is a continuation of Ser. No. 625,865, Dec. 11, 1990, abandoned.

[51] Int. Cl.[6] ..... B07B 1/28

[52] U.S. Cl. ..... 209/314; 209/319; 209/393; 209/420; 241/24; 241/69

[58] Field of Search ..... 209/234, 311, 314, 315, 209/319, 393, 395, 400, 420, 674, 3, 3.1, 5, 7, 9; 241/24, 68, 69

[56] References Cited

U.S. PATENT DOCUMENTS

| | | | |
|---|---|---|---|
| 678,819 | 7/1901 | Watkins . | |
| 760,590 | 5/1904 | Vodra . | |
| 886,247 | 4/1908 | Rechtenbach | 209/394 |
| 2,142,600 | 1/1939 | Bixby | 209/393 |
| 2,267,327 | 12/1941 | Ellen | 209/314 X |
| 3,221,877 | 12/1965 | De Koning . | |
| 3,241,671 | 3/1966 | Brauchla | 209/314 X |
| 4,197,194 | 4/1980 | Read | 209/325 |
| 4,237,000 | 12/1980 | Read et al. | 209/319 |
| 4,256,572 | 3/1981 | Read . | |
| 4,361,240 | 11/1982 | Davis et al. | 209/674 |
| 4,693,379 | 9/1987 | Stehle | 209/674 |
| 4,923,597 | 5/1990 | Anderson et al. | 209/315 X |
| 4,956,078 | 9/1990 | Magerowski et al. . | |
| 5,108,589 | 4/1992 | Sherman . | |

*Primary Examiner*—D. Glenn Dayoan
*Attorney, Agent, or Firm*—Richard P. Crowley

[57] ABSTRACT

A waste material separating apparatus and method of separating waste landfill material which apparatus and method includes a frame and a vibratory screening deck or tier within the frame, the screening deck having a plurality of generally parallel, straight rod elements to act as bludgeons on the waste material. The rod elements are removably extended from a transverse rail. Waste material to be separated into a coarse material and a finer material is discharged onto the rod element. The separating apparatus has an eccentric rotating shaft secured to the deck to impart vibratory motion to the rod elements so that the free ends of the vibratory fingers vibrate in a generally vertical direction, and bludgeon and break up the compacted solid waste landfill material. The solid material is progressively moved from the tall to short end of the frame by forward rotary motion of the rotary shaft and falls off the ends of the vibratory rod elements onto the lower tiers to decompact and break up and tumble the waste material. The finer material falls through the rod elements and is recovered within the frame while the coarse material is discharged from the short end of the frame.

16 Claims, 3 Drawing Sheets

LANDFILL WASTE MATERIAL SEPARATING METHOD

REFERENCE TO PRIOR APPLICATIONS

This application is a continuation of U.S. patent application Ser. No. 07/958,274, filed Oct. 8, 1992, now U.S. Pat. No. 5,322,170, issued Jun. 21, 1994, which is a continuation-in-part of U.S. Ser. No. 07/834,641, filed Feb. 12, 1992, now U.S. Pat. No. 5,219,078, which is a continuation of U.S. Ser. No. 07/625,865, filed Dec. 11, 1990 now abandoned.

BACKGROUND OF THE INVENTION

Soil and loam screening apparatus are known in which a screening apparatus includes a frame and a pail of sloping vibratory shaker screens supported within the frame. Generally, the frame has a tall end and a short end joined by two sides and has funneling surfaces directed toward the upper shaker screen. Soil or other material to be screened is dumped onto the upper shaker screen, for example, from the shovel of a payloader, falls from the lower end of the upper shaker screen outside of the frame, while the material which is smaller than the screen of the upper frame passes through the upper shaker screen to a lower vibratory screen of smaller opening dimensions which permits coarser material to be discharged at the one short end of the frame and finer material to pass through the lower shaker screen either onto a conveyor belt or within the frame for later retrieval. Such vibratory loam and soil material screening apparatuses are described in U.S. Pat. No. 4,197,194, issued Apr. 8, 1980; U.S. Pat. No. 4,237,000, issued Dec. 2, 1980; U.S. Pat. No. 4,256,572 issued Mar. 17, 1981; and U.S. Pat. No. Des. 263,836, issued Apr. 13, 1982, hereby incorporated by reference and which apparatuses are known in the industry as Read Screen-All® soil separating apparatuses (Read Screen-All® is the registered trademark of James L. Read, Middleboro, Mass.).

Generally, the shaker screen assembly in the above-described loam and soil material separating apparatus is secured by compression springs and the shaker assembly bounces on the springs in a rotary-type movement. Movement is imparted by the operation of an off balance shaft mechanism secured to the upper and lower shaker mechanisms generally by an off balance flywheel secured to each end of a shaft, which shaft is driven by a hydraulic motor. Generally, the upper shaker screen is composed of a woven wire assembly of typically large diameter wire in order to withstand the impact of soil or another heavy material dumped by a payloader directly onto the upper screen assembly, and which soil material may include large rocks or other heavy debris, while the screen of the lower shaker assembly is usually of smaller diameter wire and having smaller openings with the diameter of the woven screen and openings selected for the particular separation desired.

While loam and soil material are generally quickly and efficiently separated in the above-described separating apparatus, where the feed material to the apparatus comprises a wide variety of material such as that found in dumps, which would include leaves, paper bags, sticks, as well as sand, soil, rocks, twigs, cans, bottles, tires, domestic and industrial garbage and trash, and construction site debris, the separation of such material becomes much more difficult.

There are a wide variety of vibratory screening apparatus employed to screen various, disparate feed-type materials, and which vibratory screening apparatus rather than using woven screens, comprise comb or finger-like members composed of rods arranged in a series of decks over which the feed material is passed to be separated. Typically, the screening decks are arranged in a shingle array fashion, with each deck generally horizontally or slightly downwardly tilted from the horizontal and having a plurality of array of finger or rod-like members projecting from a transverse frame, so as to provide for the desired separation.

One vibratory screening apparatus is described for example in U.K. Patent GB 2 134 415B, published Aug. 15, 1984, which describes a screening apparatus with a plurality of replaceable screening decks arranged transversely with finger-like members defining spaces therebetween and which spaces diverge in a direction from the transverse screen portion of the apparatus. In addition, a similar screening apparatus is described in U.S. Pat. No. 4,693,379, issued Sep. 15, 1987, which apparatus includes a plurality of inclined, open-ended bars capable of oscillatory movement and formed in a stepped arrangement with one screen located behind the other to provide for the separation of a wide variety of materials. The screening apparatus employs bars of circular, rectangular, prismatic or T-shape profile cross section and zigzag-shaped bars for example to prevent the passage of paper sheets through the bars.

It is desirable to provide for the more efficient and effective separation of a wide variety of material, particularly waste material from landfill sites which include composted, recyclable, soil-impregnated waste material.

SUMMARY OF THE INVENTION

The present invention relates to a waste material separation apparatus and method, and particularly to a waste material separating apparatus and method employing a deck comprised of straight, vibratory separating rods for separating composted landfill waste material.

The invention comprises a separating apparatus and method, which constitutes an improvement on the Read Screen-All® separating apparatus and method. The apparatus comprises a frame, generally rectangularly to support the frame generally having a one tall end and an other short end and sides joining the ends. The one end of the frame and the width sufficiently high and sufficiently wide to permit the discharge on the feed plate of the frame and within the frame of waste feed material from a soil-carrying apparatus, such as a bucket of a payloader. The frame defines an inner space for the receipt of the finer material falling through the separating surface, while coarse material is discharged from the lower end of and outside the frame. The upper end of the frame includes a downwardly angled feed plate to receive waste material and to feed the waste material by gravity to the separating surface.

The apparatus includes a vibratory screening assembly comprising a downwardly sloping separating surface from the tall to the short end of the frame so as to separate waste feed material discharged into the frame into a coarse material which is discharged at the other short end of the frame, and a finer material which passes through the screening assembly, and within the frame and is removed from the frame by a payloader or by conveyor means. The apparatus includes a means to vibrate the screening assembly and generally as in the Screen-All® apparatus would include an hydraulic motor attached to a rotary shaft having an eccentric flywheel with the screening assembly mounted on springs so as to provide for a vibratory and forward rotary movement of the screen assembly.

The deck assembly comprises a separating surface with a plurality of screening decks or tiers arranged in a shingle-type array each of which decks comprise a cross frame member with a plurality of generally uniformly spaced apart, cylindrical rod elements secured at one end to the frame member and adapted for vibratory motion at the free end thereof in a vertical direction. The rod elements preferably are straight. The rod members define uniform spaces therebetween for the separation as desired of the waste feed material into a coarse material and a finer material, the free ends of the rod-like members extending over the secured section of the next lower tier or deck with the decks horizontal or angling slightly downward, so that the transport of the waste feed material moves from the tall end of the frame toward the other, short end of the frame, that is, the material transport path is downwardly so that coarse material is discharged out of the frame at the short end.

Generally, the conical, rod-like members are of sufficient size, that is, of a diameter and strength to withstand the waste feed material dumped onto the rod-like members. Typically, the rods may for example have a diameter of about $\frac{1}{4}$ up to $1\frac{1}{2}$ inches in diameter and be spaced apart for example from about $\frac{1}{2}$ to 8 inches and extend from about 12 to 36 inches in length. The number of rods and the number of tiers in the vibratory surface of course may vary as desired, but generally would comprise from at least three, and typically, three to six upper, overlapping decks.

The rods on the deck are mounted on a cross frame, rail or bracket, transverse member in an individual manner, that is, open end of the rod is threaded or tapped into a cross frame support with a bracket, the bracket extending transversely across substantially the width of the frame, and which is vibrated by the eccentric rotating shaft to provide forward rotary and vibratory motion to the free end of the rod. The rods are individually mounted in order to permit easy replacement of individual rods, rather than of the entire deck assembly, since damage is more likely to occur in the upper rods because of the impact and greater loads imposed on the deck.

The rotary, vibratory motion of the shaker head in the screening apparatus translates energy directly to the cross frame support members of the deck to provide vibration for example, in a Screen-All® device, at 1200 rpms, but may vary from 500 to 1500 rpms as desired with generally the free end of the rods moving from 1 to 3 inches or more in a vertical plane of vibration. The shingled array of the deck may vary, but generally it is at an angle of about 0° (horizontal) 15°, e.g. 3° to 10°, sloping downwardly toward the short end of the frame. The sloped angle of the deck is related to the rate in which the desired material is openly transported directly from the tall to the short end, so that the angle of the deck and the forward vibratory motion controls the rate of material flow down the shingled steps of the vibrating rods. Usually, the rods are positioned in a uniform plane, that is, are not offset, for each deck, the free ends of the rods of one deck slightly overlying the secured ends of the rods of the other deck.

The apparatus of the invention provides a means for the decompaction and separation of waste materials, particularly those waste materials found within a landfill.

The apparatus includes means for feeding compacted and unseparated soil-containing landfill material onto the separating apparatus which is capable of decompaction and separation in a thorough and efficient manner.

The apparatus includes a feed plate for material to be discharged onto its uppermost section which will allow compacted and unseparated material to slide down via gravity and vibration onto the high end of the frame of the material separating apparatus composed of a high (feed) end and a low (discharge) end. The feed plate allows the loading bucket of an excavator to empty its contents upstream of the separating surface which allows maximum utilization of the area provided for separation. Vibration of this feed plate is induced through the rotation of the eccentric shaft mechanism located on the shaker head. Through a combination of the angle at which this device is mounted in relation to the shaker surface, e.g. 15° to 45°, and the vibration present on the feed plate, a degree of decompaction can begin through the impact between the material and the feed plate when the excavator drops its load onto the feed plate prior to the material reaching the main separating surface.

The apparatus includes a means of lifting and throwing the waste material direction downwardly moving from the feed end of the separating apparatus to the discharge end of the apparatus for the purpose of allowing finer material, e.g. soil and fine particles, to have the opportunity to become stratified into the lower most section of the pile.

A weighted, eccentric shaft rotates within a structure outfitted for the mounting of the screening and separating surface. The relationship between the weighted, eccentric shaft and its structure must be such that a sufficient amount of vibration can be induced to allow the waste material to be lifted and thrown in a desired forward direction to cause material to move across the separating surface formed of the rods in a continuous manner for an efficient processing of waste material.

The apparatus also includes a means for providing an opening between the rods of the screening surface to allow material of a selected size to pass through the screening and separating surface by the spacing of the vibratory rods. Material passing through the surface must be allowed to do so in such a manner as to not encounter any obstruction created by the screening apparatus structure so as to allow an efficient processing of subject material.

Removable rails available with various apertures are mounted to plates which comprise part of the screening apparatus. The rails are attached to the plates by way of mounting clips which are also removable. The removable aperture rails are mounted with their length running perpendicular to the flow of the compacted waste material. These removable aperture rails are designed to withstand the forces that can be presented by loads that are dropped onto the apparatus as well as the secondary vibration intentionally induced into the screening and separating surface. A unique feature of the apparatus is that the compacted material is fed directly from the landfill onto the waste separating apparatus. This feature requires that the structure and related components be of such construction that it can resist damage from the direct loading of the feed materials onto the apparatus rather than the normal method of feeding more homogenous material using conveyors, crushers or shredders. The openings for the material to pass through are created by individually installed rods which act as bludgeons whose length run parallel to material flow attached to the removable aperture rails and are spaced apart to create any desired opening (aperture) through which material is allowed to pass.

The apparatus must include means for decompacting and separating material buried in a landfill as it is fed onto and travels across the screening and separating surface of a screening and separating apparatus.

Individually mounted rods which act as bludgeons are produced by a manufacturing process that create an elongated, cylindrical shape throughout most of their length to maintain a consistent, uniform, selected aperture parallel to the flow of material and means for mounting on one end. The one fixed end has an enlarged cross section, e.g. 10% to 25% greater, to resist the fatigue induced by the vibrational forces created when the weighted, eccentric shaft is rotated as well as to provide a means for securing the bludgeons when rotational torque is exerted while securing the bludgeons to the removable aperture rails. The bludgeons are designed to amplify the vibration created by the weighted, eccentric shaft. This unusual force that is induced into the free end of the bludgeon is one of the unique features of the invention. Wherein the few cases that a rod is used for material separating, the vibration in the rod is of such an amplitude that at best it is hoped that it will "minimize the tendency of particles to become wedged between rods and thus obstruct material flow" (as set forth in U.S. Pat. No. 4,956,078, issued Sep. 11, 1990 to Magerowski et al, page 5, line 21). This invention uses the nomenclature of "bludgeon" to describe what might normally be perceived as screen rods. The force or energy imparted into the free end of these bludgeons is for the unique purpose of decompaction of the landfill material. Objects loaded onto the screening and separating surface are violently struck by the whipping action present at the free end of each bludgeon causing a breaking apart and pulverizing of compacted material resulting in a disintegration of clumps and materials which have adhered to each other while buried and soil compacted in the landfill. In order to obtain such an unusually high degree of deflection at the free end of the cantilevered bludgeons so as to cause the decompaction of the landfill material, the supporting structure must be engineered to allow the bludgeon movement without causing damage to the structure itself. This high degree of deflection, vertical rod movement of two to six inches, is not something that is required for screening, but is necessary to achieve decompaction.

The apparatus must comprise a means for overturning compacted landfill material in order to re-orient the material passing across the screening and separating surface so as to cause the separation of a maximum amount of finer material, e.g. soil, from lighter, more bulky coarse material, e.g. plastic bottles and bags.

Substantially horizontal-positioned, individual rod bludgeons are mounted parallel to material flow in a cantilevered fashion to removable rails to accommodate various apertures or openings through which finer separated material passes after being exposed to pounding by the free end of the bludgeons are mounted to a rotationally-induced vibrating structure in a tier or stair-like fashion in groups or sections and mounted at various heights or levels. The purpose of mounting the sections at different heights from each other is to force the material as it passes along one section (being moved by the directional vibration induced by the rotating, weighted, eccentric shaft and allowing whatever finer material that is at that time stratified after decompaction by the bludgeons into the lower most section of the pile) onto the succeeding lower section to be overturned as it falls or cascades over the whipping free end of the bludgeon dropping and tumbling a substantial distance onto the fixed end of the next and lower section of rod bludgeons in the lower screening surface. The cycle is then repeated in the same aforesaid manner, causing all of the material to be repeatedly lifted, pounded, decompacted, vibrated, dropped and overturned throughout the separating process to create optimal opportunity for the maximum amount of finer material to be removed during decompacting and separating of the landfill material that is fed onto the apparatus. Additionally, a degree of decompaction is gained from the impact of the material falling from one tier or level to the next, again assisting in reaching a maximum level of productivity of the apparatus. Generally, the vertical distance from the end of one tier of vibratory rods is greater than six (6) inches and preferably the vertical distance increases from the one to the next lower tier, such as by 25% to 50% or more, to create additional impact on the waste material, e.g. 6 to 18 inches or more.

The apparatus comprises means for expediently allowing objects to be cleared from the separating surface of the apparatus that by their nature cannot be decompacted or pulverized and have no appreciable amount of recoverable fine material within their composition.

In the process of separating the landfill materials, large, heavy, solid masses can be encountered that will concentrate a great deal of weight over a relatively small number of bludgeon rods, an example being automobile engine blocks, motors, washing machines and other heavy metal objects. The bludgeon rods must therefore be capable of enduring a severe bending stress from these heavy objects without experiencing permanent deformation. The bludgeons are designed to bend from a substantially horizontal position downward on the free end to allow these heavy solid objects to slide off of the separating surface, while the bludgeon rod is flexible enough to return to its prior position and continues to perform as designed and described.

In operation, the vibration of the free ends of the cantilevered rods provides for vibratory, generally vertical up and down, motion. For example, with feed material having compost, leaves and small, organic material, the rods moving up and down strike and lift up the lightweight material, flip the material over on each tier or deck and permit the smaller material in the waste material to pass through the aperture and opening and therefore to be separated and permitting the larger and bulkier material to move downwardly to the short end of the frame.

The separating apparatus is directed to solid waste material composed of a variety of small and bulky, heavy and lightweight waste and trash material, usually a mixture of metal, glass, plastic, soil, organic material, etc., particularly compacted, i.e. previously buried, waste material from a landfill. Such waste material from past landfills are composed of layers of trash material, each layer covered by layers of dirt or soil, which layers are composted on site and contain high amounts of moisture which causes waste material to adhere together. The waste feed is composted and contains composted adhering soil therein. The separating apparatus provides for efficient decompaction and separation of the composed soil from the waste material by the bludgeon-type action of the vibratory rods in each tier and by the progressively greater gravity fall and tumbling of the waste material, as it moves progressively downward from tier to tier or deck to deck toward the short or discharge end of the frame. The bludgeoning action, gravity fall and tumbling or turn over of the waste material loosens and separates compacted soil and finer material admixed and compacted in the waste material and provides for the decompacted finer material to fall through the selected apertures or openings between the vibratory rods.

The energy present in the free end of the bludgeon rod is essential to agitate and excite the waste material directed onto the separating surface to allow the maximum amount of finer material to be removed and separated from the original waste material requiring the removal of the fine material from coarse material.

The bludgeon rods are situated in such a manner as to cause a tumbling or overturning of material as it passes from one tier to the next in a cascading manner. The free, vertically deflecting end of one array of cantilevered bludgeons moves material in conjunction with rotative action in a horizontal, forward direction towards the next lower tier and again the process is repeated. As the material drops from the free, deflecting end of an array of bludgeons, the material is flipped, tumbled or overturned as it falls causing the release or separating of finer material from coarse material. Without this tumbling action, fine material could remain on top of coarse material throughout the duration of time that any fine material has the opportunity to fall between the spaces created between the bludgeons. Bludgeon rods are designed to take a heavy load, allow material to fall between them, lift material up in the air, e.g. light enough, pulverize by repeatedly striking or bludgeoning objects, flip material over by lifting and pushing it from one tier to the next, and begin striking of waste material as it lands from the above-preceding tier. This action is repeated in each tier. The number of tiers or decks may vary as desired to provide the desired degree of decompaction and separation.

The bludgeon rods are designed to perform at a substantially horizontal plane and under severe heavy loads and to deflect to a downward incline to assist heavy loads or objects to travel off of the separating surface.

In operation, the feed waste material to be separated is discharged onto the angled feed plate where the waste material feeds by gravity onto the upper surface of the vibrating rods. The coarser material which is unable to pass through the opening of the vibrating rods moves downwardly and is discharged outside of the frame toward the short end. Finer soil and decompacted waste material fall through the opening of the vibrating rods.

The invention will be described for the purposes of illustration only in connection with certain illustrated embodiments; however, it is recognized that those persons skilled in the art may make various modifications, changes, improvements and additions to the illustrated embodiments all falling within the spirit and scope of the invention.

DESCRIPTION OF THE EMBODIMENTS

Figure 1:
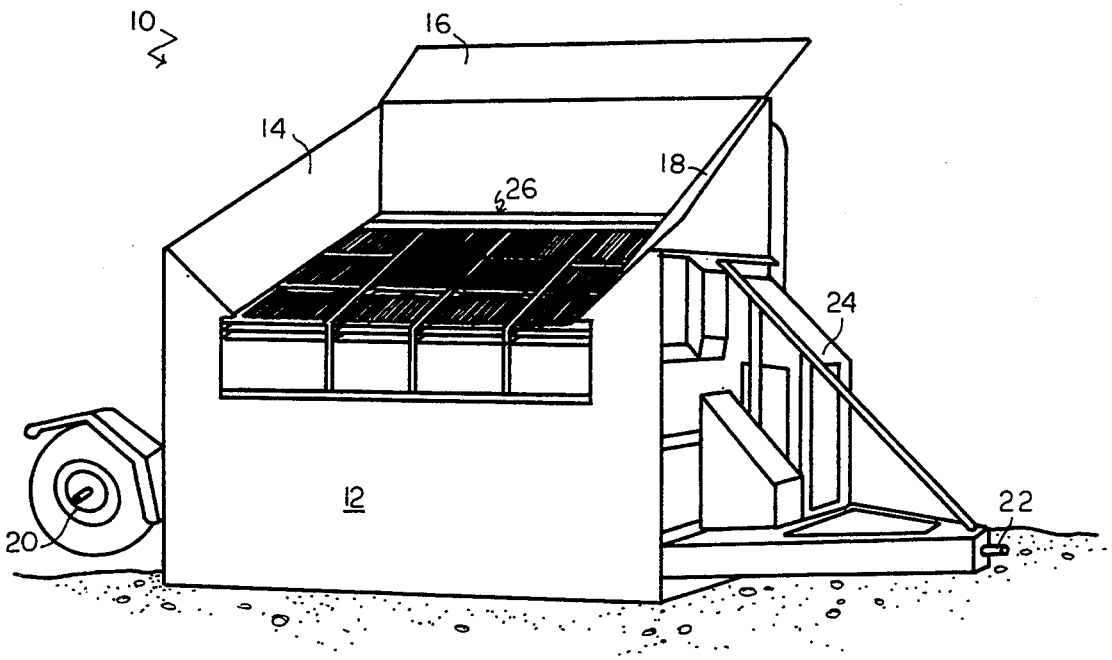
FIG. 1 is a perspective view from above of a waste material separating apparatus of the invention.

FIG. 1 shows a compacted landfill waste separating apparatus 10 having a frame 12 closed at the one end and open at the opposite end (not shown) to define an inner space for the recovery of finer waste material. The apparatus 10 includes angled side funneling surfaces 14, 16 and 18. Funnel plate 16 acts as an elongated feed plate, for example, at an angle of about 45° to 53° and having a plate surface length of five feet or more. The feed plate 16 receives the compacted landfill waste material and is sufficiently angled and long to provide for the start of decompaction and stratification of the waste material prior to discharge by gravity of the waste material onto the screening surface 26. The apparatus 10 comprises a portable, towable, wheeled separation apparatus having a pair of wheels 20 at the one end for road transportation of the apparatus with the wheels movable relative to the frame 12, while at the other end there is a tow bar and trailer hitch 22 for towing the apparatus by vehicle and a hydraulic motor within housing 24 to provide forward rotary and vibratory motion to the screening surface 26 by an off-center, eccentric shaft mechanism as in Read patents supra.

Figure 2:
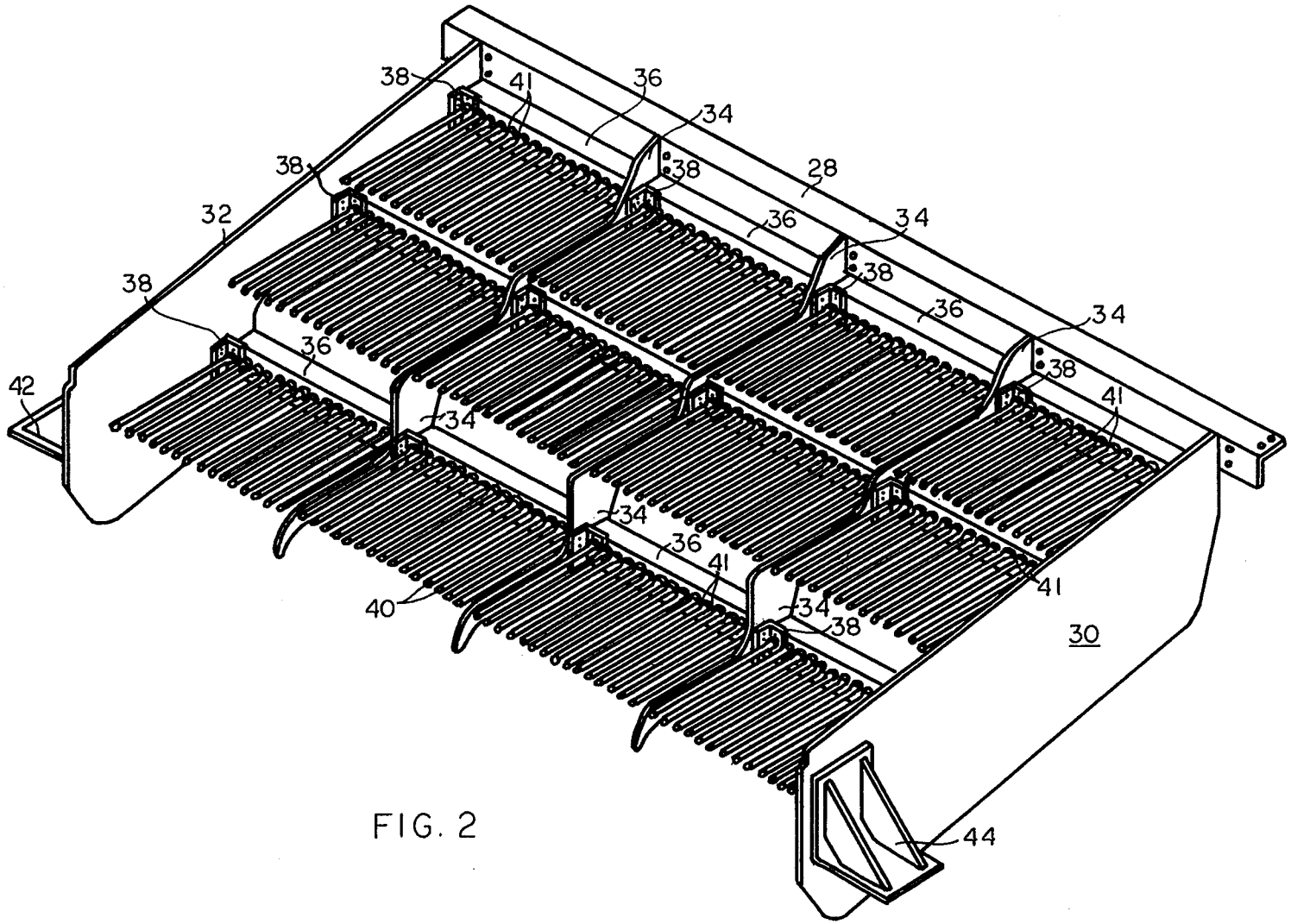
FIG. 2 is an enlarged perspective view of the screening surface deck of the apparatus of FIG. 1.

The screening surface 26 is illustrated more particularly in FIG. 2 and comprises an angle using transverse spring support 28 mounted on springs (not shown) to the frame 12 with side plates 30 and 32 and having a plurality of center plates 34 secured to and extending tom the spring support 28 to divide the screen surface 26 into four equal sections. The center plates 34 are contoured at the top surface to fit the plane of the screening surface 26 at each level. The center plates 34 provide additional support for support 28 during the vibratory motion of the surface 26 within frame 12. The side plates 30 and 32 are secured at the one tall end to the support 28 and have bracket spring supports 36 and 38 at the other short end which brackets 36 and 38 are supported on springs (not shown) to the frame 12. Aperture mounting rails 36 extend between and are secured to side plates 30 and 32 by mounting clips 38. A plurality of cylindrical, metal, flexible side bracket rods 40 are secured at the one end through bolts to the mounting rail 36. Typically, the rods have a length of three feet and at the one bolted end are about $1\frac{1}{2}$ inches in diameter (10% of length) and extend to the other vibrating end with a diameter of about $\frac{3}{4}''$, the rods uniformly parallel and spaced apart, and being in the same horizontal place and spaced about one to three inches. The threaded bolting of the individual rods 40 permits the rods to be replaced individually in the event repair or replacement is required. As illustrated, the separation apparatus 10 includes a three tier deck with the other vibratory end of the rods 40 extending generally horizontally slightly over the one end of the rods 40 of the next lower tier or deck.

Figure 3:
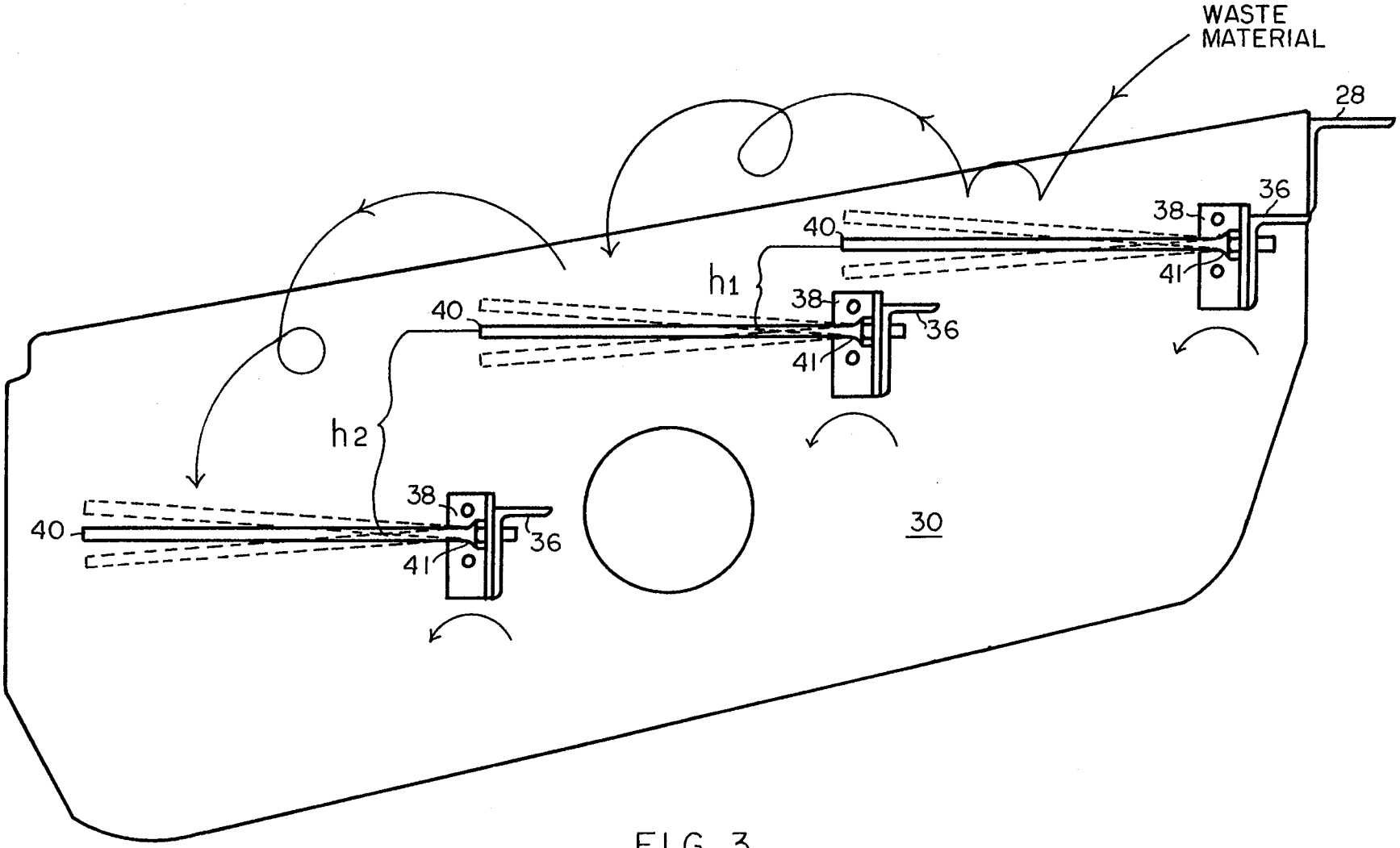
FIG. 3 is an enlarged side view of the deck of the waste material separating apparatus of FIG. 1.

FIG. 3 illustrates the rods 40 in each tier having an enlarged diameter 41 at the core end and with a vertical, vibratory motion illustrated in dotted lines, the vibration caused by the off-center shaft rotating forwardly the spring-mounted screening surface 26 of rods in frame 12. Typically the free end of the rod will move a vertical distance of about one to three or more inches. The free end of the rods 40 in the first upper deck or tier are mounted about six to twelve inches, e.g. nine to twelve inches, above the next lower of middle tier, while the rods 40 of the middle tier are mounted about 12" to 18", e.g. 12" to 14", above the plane of the next and lowest tier.

In operation, compacted, soil-containing landfill waste material is discharged by a payloader shovel or bucket onto angled feed late surface 16 and permitted to slide downwardly onto the first tier of screening surface 26. The compacted landfill material is decompacted of soil by progressive, forward movement from the first, second and third tier of vibrating rods 40 which act as bludgeons to strike forcefully at the free end the solid waste material in its forward movement impelled by the forward rotary action of the off-center shaft to break up the solid material and dislodge the finer, individual material which falls between the rod apertures and into the inner space within frame 12.

The vibratory motion of the rods 40 also act to turn over and tumble the solid material as it moves from the higher to the next lower tier. In addition, the progressively greater vertical distance between each tier also adds impact energy to dislodge finer material from the waste material, so that the larger, bulky waste material is discharged onto the ground adjacent the short end of frame 12.

The apparatus and method as described and illustrated provides for the rapid, efficient separation of solid, soil-containing waste material, particularly compacted landfill waste material.

I claim:

1. A method of separating a compact, soil-containing, solid waste material into a coarser material, and a mixture of decompacted soil and a finer material, which method comprises:

a) removing landfill solid waste material from a landfill, the waste material comprising a compact, soil-containing, mixture of solid waste material composed of small and bulky, heavy and light weight waste material which contains soil adhering to the waste material;

b) providing a separating surface means comprising a plurality of generally horizontal tiers arranged in a vertical, spaced-apart, stepped arrangement within a frame having a tall end and an opposite, other, short end, the tiers having a transverse mounting rail and a plurality of rod elements having a one and a free other end and secured at the one end to the mounting rail, the rod elements in each tier generally parallel and spaced apart a defined separation distance in a transverse plane to form an open space therebetween;

c) providing a downwardly angled funneling surface adjacent to the separating surface means at the tall end of the frame, to receive waste material;

d) dumping the removed landfill solid waste material onto the funneling surface to start decompaction of the waste material and moving the partially decompacted dumped waste material by gravity downwardly on the funneling surface;

e) vibrating the separating surface means to provide for the vibratory, generally vertical movement of the other, free ends of the rod elements;

f) feeding the dumped partially decompacted waste material by gravity from the funneling surface onto the separating surface means;

g) bludgeoning the partially decompacted waste material on the separating surface means with the other vibrating free end of the rod elements at each tier to decompact the compacted soil from the waste material and to permit the soil and finer waste material to fall through the open space and within the frame;

h) tumbling and turning over of at least some of the light weight waste material at each tier by the vibratory movement surface separating means and by the vertical movement of the other vibratory free end of the rod elements;

i) moving the waste material by the vibratory movement of the separating surface means downwardly from each tier from the tall end to the short end of the frame;

j) decompacting further the waste material as it moves downwardly from the tall to the short end of the frame by discharging the waste material by gravity from each tier to the next lower tier;

k) discharging the solid, decompacted, coarser solid waste material from the short end of the frame; and l) discharging the finer separated waste material and decompacted soil within the frame.

2. The method of claim 1 which includes varying the downward angle of the tiers to control the rate of waste material flow from the tall to the short end of the frame.

3. The method of claim 1 which includes providing a vibratory movement of about 500 to 1500 rpms to the separating surface means.

4. A method of claim 1 which includes feeding the waste material first onto a downwardly angled feed plate secured to and extending upwardly from the tall end of the frame and directly above the funneling surface and separating surface means to start the decompaction of the waste and soil contained in the waste material and feeding the partially soil-waste decompacted waste material from the downwardly angled feed plate onto the vibrating separating surface means.

5. The method of claim 1 which includes vertically vibrating the other free vibratory end of the rod elements a vertical distance of from about 1 to 6 inches.

6. The method of claim 1 which includes progressively increasing the vertical distance between the tiers from the tall to the short end of the frame.

7. The method of claim 6 which includes providing a vertical distance between the tiers of at least six inches.

8. The method of claim 4 which includes inducing vibration of the outwardly angled feed plate means by vibration of the separating surface means to induce the start of decompaction of the solid waste material on the feed plate means prior to reaching the separating surface means.

9. The method of claim 1 wherein the tiers are sloped with a downwardly sloped angle of up to about 15° from the horizontal.

10. The method of claim 1 which includes providing rod elements having a diameter of up to about 1½ inches in diameter, and which rod elements are spaced apart, up to about 8 inches and extend from about 12 to 36 inches in length.

11. The method of claim 1 which includes providing a number of tiers ranging from about 3 to 6 tiers.

12. The method of claim 1 which includes providing rod elements of generally elongated, cylindrical, straight shape and wherein one fixed end of the rod elements has an enlarged diameter section.

13. The method of claim 1 which includes dumping the solid waste material onto a downwardly angled feed plate extending outwardly of the frame and funneling surface and having a downward angle of greater than about 45° and having a length of greater than about 3 feet and feeding the partially decompacted solid waste material from the feed plate onto the separating surface means.

14. The method of claim 1 which varies the angle of the tiers from about horizontal (zero degrees) to 15 degrees.

15. The method of claim 1 which includes vibrating the vibratory surface means by rotating an eccentric shaft by a hydraulic motor.

16. The method of claim 1 which provides for transporting the separating surface means to a landfill site for the removing of landfill waste material by towing the separating surface means mounted on wheels to the landfill site.

* * * * *